US010625929B2

(12) United States Patent
Bartolucci et al.

(10) Patent No.: US 10,625,929 B2
(45) Date of Patent: Apr. 21, 2020

(54) DISPENSER WITH A RESILIENT OUTLET VALVE

(71) Applicant: The Procter & Gamble Company, Cincinnati, OH (US)

(72) Inventors: Stefano Bartolucci, Singapore (SG); Paul O. Nutley, Cincinnati, OH (US); Nathan Daniel Grubbs, Cincinnati, OH (US)

(73) Assignee: The Procter and Gamble Plaza, Cincinnati, OH (US)

( * ) Notice: Subject to any disclaimer, the term of this patent is extended or adjusted under 35 U.S.C. 154(b) by 0 days.

(21) Appl. No.: 15/926,075

(22) Filed: Mar. 20, 2018

(65) Prior Publication Data

US 2018/0273280 A1 Sep. 27, 2018

(30) Foreign Application Priority Data

Mar. 21, 2017 (EP) ..... 17162178

(51) Int. Cl.

| | |
|---|---|
| ***B65D 83/20*** | (2006.01) |
| ***B65D 83/28*** | (2006.01) |
| ***B65D 83/14*** | (2006.01) |
| ***B05B 11/00*** | (2006.01) |

(52) U.S. Cl.

CPC ..... *B65D 83/206* (2013.01); *B65D 83/28* (2013.01); *B65D 83/7535* (2013.01); *B05B 11/0064* (2013.01)

(58) Field of Classification Search

CPC ..... B65D 83/207; B65D 83/7535; B65D 83/206; B65D 83/28; B65D 83/303; B65D 83/306; B65D 83/34; B65D 83/345; B65D 83/753; B05B 1/323; B05B 11/0064; B05B 11/0072

USPC ..... 222/495, 496, 402.12, 529, 531, 532, 222/537, 491, 494, 402.2; 137/843

See application file for complete search history.

(56) References Cited

U.S. PATENT DOCUMENTS

| | | | |
|---|---|---|---|
| 2,430,718 | A | 11/1947 | Jacobson |
| 3,104,785 | A | 9/1963 | Beard, Jr. |
| 3,235,135 | A | 2/1966 | Henri |
| 3,247,640 | A | 4/1966 | Miles et al. |
| 3,250,444 | A | 5/1966 | Ward |

(Continued)

FOREIGN PATENT DOCUMENTS

| | | | |
|---|---|---|---|
| DE | 3147004 | A1 | 5/1983 |
| FR | 1454371 | A | 9/1966 |

(Continued)

OTHER PUBLICATIONS

European Search Report for 17162178.2 dated Aug. 21, 2017.

(Continued)

*Primary Examiner* — Patrick M. Buechner
(74) *Attorney, Agent, or Firm* — Alexandra S. Anoff

(57) ABSTRACT

A dispensing device for dispensing a foamable product. The dispensing device comprises a valve. The valve comprises: a plug; a seat configured to receive the plug; and one or more resilient arms coupled to the plug, configured to bias the plug against the seat. The valve has a closed configuration in which the plug is received by the seat, and an open configuration in which the plug is displaced from the seat.

18 Claims, 8 Drawing Sheets

(56) References Cited

U.S. PATENT DOCUMENTS

| | | | | |
|---|---|---|---|---|
| 3,490,658 | A * | 1/1970 | Schwartzman | B05B 1/3006 222/402.12 |
| 3,981,419 | A | 9/1976 | Nilson | |
| 4,171,074 | A * | 10/1979 | Diamond | C21B 9/02 222/402.22 |
| D267,855 | S | 2/1983 | French | |
| 4,433,797 | A | 2/1984 | Galia | |
| 4,562,942 | A | 1/1986 | Diamond | |
| 4,592,743 | A | 6/1986 | Hjertman et al. | |
| 4,694,975 | A | 9/1987 | Hagan | |
| 4,892,232 | A | 1/1990 | Martin | |
| 4,896,832 | A | 1/1990 | Howlett | |
| 4,919,312 | A | 4/1990 | Beard | |
| 4,941,598 | A | 7/1990 | Lambelet, Jr. et al. | |
| 5,031,802 | A | 7/1991 | Joulia | |
| 5,056,690 | A | 10/1991 | Ichihara | |
| 5,105,995 | A | 4/1992 | Martin | |
| 5,199,616 | A | 4/1993 | Martin | |
| 5,429,280 | A | 7/1995 | Bauer et al. | |
| 5,441,181 | A | 8/1995 | Scheindel | |
| 5,520,310 | A | 5/1996 | Bauer et al. | |
| 5,875,927 | A | 3/1999 | Andrade | |
| 5,904,274 | A | 5/1999 | Warby | |
| 6,095,182 | A | 8/2000 | Warby | |
| 6,334,553 | B1 | 1/2002 | Bouras | |
| 6,405,898 | B1 | 6/2002 | O'Connor et al. | |
| 6,745,920 | B2 | 6/2004 | Gupta | |
| 7,104,424 | B2 | 9/2006 | Kolanus | |
| 7,306,123 | B2 | 12/2007 | Masuda | |
| 7,306,124 | B2 | 12/2007 | Masuda | |
| 7,665,923 | B2 | 2/2010 | Py et al. | |
| 8,006,868 | B2 | 8/2011 | Geiberger et al. | |
| 8,387,827 | B2 | 3/2013 | Helf | |
| 8,616,417 | B2 | 12/2013 | Neuhaus | |
| 8,720,747 | B2 | 5/2014 | Hoagland | |
| 9,211,994 | B2 | 12/2015 | Andersen | |
| 9,403,636 | B2 | 8/2016 | Bodet et al. | |
| 9,469,468 | B2 | 10/2016 | Shibata | |
| 10,022,740 | B2 | 7/2018 | Van Swieten et al. | |
| 10,364,093 | B2 | 7/2019 | Bartolucci | |
| 2002/0162450 | A1 | 11/2002 | Frost | |
| 2004/0112920 | A1 * | 6/2004 | Felten | B65D 47/2075 222/212 |
| 2006/0065677 | A1 | 3/2006 | Py | |
| 2006/0196889 | A1 | 9/2006 | Masuda | |
| 2007/0051754 | A1 | 3/2007 | Strand | |
| 2007/0095853 | A1 | 5/2007 | Bonney et al. | |
| 2007/0125799 | A1 | 6/2007 | Bonney | |
| 2007/0137643 | A1 | 6/2007 | Bonney | |
| 2007/0164049 | A1 | 7/2007 | Bonney | |
| 2007/0175917 | A1 | 8/2007 | Bonney | |
| 2008/0061083 | A1 | 3/2008 | Masuda | |
| 2008/0149098 | A1 | 6/2008 | Bonney | |
| 2008/0272144 | A1 | 11/2008 | Bonney | |
| 2010/0308082 | A1 | 12/2010 | Lamble | |
| 2011/0011889 | A1 | 1/2011 | Bonney | |
| 2012/0006859 | A1 | 1/2012 | Wilkinson | |
| 2013/0019802 | A1 | 1/2013 | Leck | |
| 2013/0068119 | A1 | 3/2013 | Kennedy | |
| 2015/0090736 | A1 | 4/2015 | Erickson et al. | |
| 2019/0071242 | A1 | 3/2019 | Bartolucci | |
| 2019/0152684 | A1 | 5/2019 | Bartolucci | |

FOREIGN PATENT DOCUMENTS

| | | | |
|---|---|---|---|
| FR | 2311593 | A1 | 12/1976 |
| FR | 2990421 | B1 | 2/2015 |
| GB | 1414637 | A | 11/1975 |
| WO | 2004045778 | A1 | 6/2004 |

OTHER PUBLICATIONS

European Search Report for EP 17175852.7 dated Sep. 19, 2017.
European Search Report for EP 17189053.6 dated Feb. 28, 2018.
European Search Report for EP 17203315.1 dated May 4, 2018.
PCT International Search Report and Written Opinion for PCT/US2018/058653 dated Jan. 25, 2019.
U.S. Appl. No. 16/184,367, filed Nov. 8, 2018, Bartolucci et al.
U.S. Appl. No. 16/194,502, filed Nov. 19, 2018, Bartolucci et al.
U.S. Appl. No. 16/666,879, filed Nov. 1, 2019, Bartolucci et al.

* cited by examiner

DISPENSER WITH A RESILIENT OUTLET VALVE

FIELD OF THE INVENTION

The present invention relates to dispensing devices for foamable products. In particular, it relates to dispensing devices for foamable personal care products.

BACKGROUND OF THE INVENTION

Dispensing devices for dispensing a foamable product from a container are known in the art. In one example, the dispensing device is disposed on top of a pressurized container containing a foamable product. The dispensing device comprises a flow passage that is coupled at one end to a discharge valve of the pressurized container. A discharge outlet is provided at the other end of the flow passage. To dispense the foamable product, the user presses an actuator part of the dispensing device. This opens the discharge valve of the container. Product then flows into the flow passage and is discharged through the discharge outlet. This discharge occurring from the discharge outlet is driven by the flow of foamable product entering the flow passage from the container, propelled by the vapor pressure of the propellant in the container. The foamable product also expands into a foam within the flow passage as it is being dispensed, such that the volumetric flow rate at the discharge outlet is greater than that at the discharge valve of the container.

After a desired amount of foam has been dispensed, the user releases the actuator, closing the discharge valve of the container, and thereby shutting off the supply of product to the flow passage. However, continued expansion of the product that is already in the flow passage can cause the product to drool out of the discharge outlet.

For present purposes, drool can be defined as an unwanted discharge of foam (or foamable product) from a discharge outlet after dispensing has been stopped by a user, caused by the continued expansion of the foam in the passage between the container-valve and the discharge outlet.

A dispensing device for a foamable product is known from U.S. Pat. No. 6,405,898. It features a system to reduce drool.

In one embodiment, the dispensing device features a nozzle member comprising a flow passage and a movable portion movable between a discharge position and an inactive position. When the movable portion is in the discharge position, the flow passage is in fluid communication with the exterior of the device. When the movable portion is in the inactive position, the flow passage is in fluid communication with a waste product containment region. As such, when the movable portion is in the discharge position and foam is being discharged, the foam is directed to the exterior of the dispensing device. After discharge, and with the movable portion in the inactive position, foamable product (and/or foam) remaining in the flow passage is directed into the waste product containment region.

With the dispensing device of U.S. Pat. No. 6,405,898, there is a chance for undesired leakage of the foamable product from the nozzle member, particularly during a transient period when the movable portion is between the discharge position and the inactive position. Also, an amount of the dispensed product will be collected in the waste product containment region and therefore wasted. These drawbacks are particularly severe with foamable compositions that have high blooming—potentially increasing 5-10 times in volume from the moment they are dispensed to their fully expanded state. For such compositions, the amount of product collected inside the dispensing device will not only be wasted, but it can also expand until it leaks out of the containment region, thereby creating a mess and giving the impression that the dispensing device is not functioning properly.

SUMMARY OF THE INVENTION

The present inventors have recognized that it would be desirable to provide a dispensing device for foamable products that exhibits minimal drool—in particular for foamable products with very high post actuation blooming. Even more desirably, this would be done without wasting an amount of the product or sacrificing the flow rate of foamable product during dispensing. The inventors have also recognized that it would be desirable to provide a dispensing device with a less complex design that is simpler and more economical to manufacture.

The invention is defined by the claims.

According to an aspect of the invention there is provided a dispensing device for dispensing a foamable product, the dispensing device comprising a valve, the valve comprising:

a plug;

a seat configured to receive the plug; and one or more resilient arms coupled to the plug, configured to bias the plug against the seat, the valve having a closed configuration in which the plug is received by the seat, and an open configuration in which the plug is displaced from the seat.

In the closed configuration, the plug restricts the flow of the product through the valve. In the open configuration, the product can pass through the valve. The product may pass through the valve by flowing around the periphery of the plug, in the open configuration. The product may flow around the one or more resilient arms. If there is more than one resilient arm, the product may flow between the resilient arms.

A valve with this construction has been found to be particularly advantageous for preventing drooling of a foamable product after a dispensing event. The structure of the valve also facilitates easy and economical manufacturing. For example, it may be possible to manufacture the valve by injection molding a small number of separate components and then assembling them, potentially avoiding the need for more complex manufacturing techniques such as bi-injection molding. The valve can achieve a relatively high flow-rate.

The valve may comprise a poppet check valve or poppet relief valve.

The seat preferably comprises an aperture. In the closed configuration, the plug preferably locates in this aperture to restrict the flow of the product.

The plug is preferably suspended concentrically in the aperture by the one or more resilient arms.

The dispensing device is preferably suitable for dispensing an aerosol foam from a container that contains the foamable product and a propellant.

In a preferred embodiment, the plug and the one or more arms may be formed of a silicone rubber and the seat may be formed of polypropylene.

The one or more resilient arms may extend radially from the plug.

The arms may extend partly axially and partly radially. This can allow the plug to be suspended relative to the seat without interfering with the seat's ability to receive the plug.

The one or more resilient arms may extend from the plug at an oblique angle.

That is, at least a part of the one or more arms extends at an oblique angle between a radial direction and an axial direction of the plug. The axial direction of the plug is defined by the axis of displacement of the plug away from the seat. The radial direction is perpendicular to the axial direction.

The one or more resilient arms may be coupled to the plug at a side of the plug facing away from the seat.

The plug may taper inwardly in the direction toward the seat.

For example, the plug may have a conical, frusto-conical, pyramidal or frusto-pyramidal shape.

The plug may taper at an angle in the range 20° to 60°, preferably in the range 30° to 45°, more preferably about 45°. The angle of taper is defined relative to the axial direction of the plug. Thus, a smaller angle of taper (for example, approaching 0°) would imply a relatively longer, more pointed plug, whereas a larger angle of taper (for example, approaching 90°) would imply a relatively short, flat plug.

In some embodiments, the plug and the seat cooperate to define an opening of annular cross section around the plug, when the valve is in the open configuration. The resilient arms may be disposed in front of the opening (that is, at the external side of the plug), whereby the resilient arms partially occlude the opening when viewed from the front (external side).

The seat may comprise an aperture that tapers inwardly in the direction away from the plug.

The aperture may taper with a convex rounded profile. The rounded profile may have a fillet radius of greater than 1 mm.

In some embodiments, the seat may comprise an aperture that tapers inwardly in the direction away from the plug; and the plug may taper inwardly in the direction toward the seat, wherein the tapered plug is configured to form an interference fit with the tapered aperture in the closed configuration of the valve.

The plug may be configured to resiliently deform against the tapered aperture in the closed configuration. Preferably, the interference between the plug and the aperture is in the range 10 to 30 mil, or 0.25 to 0.77 mm. This dimension is measured in a direction perpendicular to the surface of the plug at the point of contact. Preferably, the interference is substantially uniform around the plug.

The tapered plug may contact the tapered aperture at a tangent to the rounded profile of the aperture. This can help to form a more effective seal, for better restricting the flow of product in the closed configuration.

The valve may further comprise a sleeve, and the one or more resilient arms may be coupled to an interior surface of the sleeve to suspend the plug inside the sleeve.

The arms may suspend the plug concentrically within the sleeve. The sleeve may be tubular.

The sleeve may comprise a radial flange for securing the valve in the dispensing device.

In particular, the flange may help to secure the valve against movement in an axial direction of the plug.

The plug and the one or more resilient arms may be formed integrally from an elastomeric material.

Here, integrally formed means formed as a single unitary piece. For example, the plug and the arms may be formed in the same mold (in a single contiguous mold-cavity).

If the valve comprises a sleeve as summarized above, then the plug, the arms, and the sleeve may all be formed integrally from the elastomeric material.

The elastomeric material may comprise a natural or synthetic rubber such as silicone rubber, polyurethane, polybutadiene (Buna rubber), or fluorinated hydrocarbon (such as Viton).

The elastomeric material may have a Shore A hardness in the range 35 to 75.

The dispensing device may further comprise a dispensing channel, the dispensing channel having: an inlet for communicating with a valve-element of a container containing the foamable product; and an outlet for dispensing the foamable product, wherein the valve of the dispensing device is located at the outlet of the dispensing channel.

If the container has a male-type valve, the valve-element may be a valve-stem. If the container has a female-type valve, the valve-element may be a spring cup.

The dispensing channel may comprise a tube, wherein the seat comprises an end of the tube.

To minimize the number of components, the seat may be formed by the end of the tube.

The valve may comprise a sleeve; the one or more resilient arms may be coupled to an interior surface of the sleeve to suspend the plug inside the sleeve; and the end of the tube may project into the sleeve such that the plug locates against the seat in the closed configuration.

The dispensing device may further comprise an actuator configured to bias the inlet of the dispensing channel against the valve-element of the container.

When the inlet bears against the valve-element to a sufficient extent, the discharge valve of the container opens, allowing the foamable product to flow out of the container into the dispensing channel.

The dispensing channel may be flexible and resilient.

This can allow the inlet of the dispensing channel to be biased against the valve-element of the container by flexing of the dispensing channel. This may enable the outlet of the dispensing channel to remain static relative to the container, while the actuator is being actuated and the product is being dispensed.

The dispensing channel is preferably elastically deformable. The dispensing channel is preferably defined at least in part by a flexible resilient material, optionally a flexible resilient plastic material, such as a polyolefin. Most preferably, the dispensing channel is formed of polypropylene.

The inlet and outlet of the dispensing channel may have different orientations. Optionally, the dispensing channel may include a bend or corner. In particular, the dispensing channel may include a bend or corner such that the outlet is oriented differently to the inlet. An angle between the inlet and outlet may be in the range 30° to 150°, preferably in the range 45° to 135°, more preferably in the range 60° to 120°. (Here, an angle of 0° would indicate that the inlet and outlet have the same orientation.)

The dispensing device may further comprise a shroud for concealing the dispensing channel when the dispensing device is attached to a container containing the foamable product, wherein the position of the outlet of the dispensing channel is fixed relative to the shroud.

In particular, the outlet may remain stationary when the foamable product is being dispensed (or respectively, when the actuator is actuated). Moreover, the outlet may remain stationary when the inlet is displaced as the foamable product is being dispensed.

The dispensing device may further comprise a container containing the foamable product, wherein the valve-element of the container may be coupled to the inlet of the dispensing channel.

If the dispensing device comprises a shroud, the shroud may engage with the container.

If the outlet of the dispensing channel is fixed relative to the shroud, then the outlet is preferably also fixed relative to the container.

The foamable product may form a foam having a density in the range 0.4 to 0.5 g/cm$^3$ immediately after dispensing. The foam may have a density in the range 0.1 to 0.2 g/cm$^3$ one minute after being dispensed. Thus the foam may continue to expand significantly for some time after it has been dispensed.

The cracking pressure of the valve of the dispensing device may be less than a dispensing pressure of the container but greater than an expansion pressure of a foam formed by the foamable product in the dispensing channel after dispensing.

This means that the valve can open automatically when the dispensing pressure is applied to it. This happens when the discharge valve of the container is opened by actuation of the actuator and the foamable product released from the container.

For the purposes of the present disclosure, "cracking pressure" is defined as the minimum pressure at which the forward steady state flow rate is at least 5 ml/s, when tested with water using the experimental method defined in the specification.

The "dispensing pressure" is preferably the pressure of the product inside the aerosol container.

The "expansion pressure" of the foam is the pressure that develops inside the dispensing channel after foam has been dispensed. This pressure exists because, when the discharge valve of the container is closed after dispensing, the residual foam in the dispensing channel continues to expand. The pressure will be greatest immediately after dispensing stops (that is, just after the discharge valve of the container closes). The "expansion pressure" refers to this peak pressure in the dispensing channel.

After the product has been dispensed, the discharge valve of the container is closed (typically, the discharge valve of the container closes when the actuator is released). The valve of the dispensing device then closes automatically, since the expansion pressure of the residual foaming product in the dispensing channel is less than the cracking pressure of the valve. This enables the valve to reduce drooling of the foamable product from the outlet of the dispensing channel.

Preferably, the flow rate of foamable product through the valve of the dispensing device is less than 5 ml/s after the discharge valve of the container is closed.

The cracking pressure of the valve of the dispensing device is preferably at least one third and more preferably at least half of the dispensing pressure of the container.

The container may contain a cosmetic product and a propellant.

The cosmetic product may comprise a foamable hair cosmetic product, such as a foamable shampoo or foamable conditioner. Expansion pressures of such products may be higher than other foamable products typically dispensed in this way. Therefore, it is particularly desirable to obtain better control of drooling for such products.

The valve may have a cracking pressure in the range 5 to 30 PSIG, or 34 to 207 kPaG.

The cracking pressure is preferably in the range 10 to 30 PSIG, or 69 to 207 kPaG, more preferably in the range 20 to 30 PSIG, or 138 to 207 kPaG.

It has been found that a flow rate of around 20 ml/s is preferred by consumers so that the delivery rate of foam is perceived as neither too slow nor too fast.

The valve may provide a flow-rate in the range 15 to 25 ml/s at a pressure of 50 PSIG, or 345 kPaG. Preferably, the flow-rate at this pressure is in the range 18 to 22 ml/s.

The valve design and assembly can be adjusted to target the same consumer preferred flow rate range given different dispensing pressures according to the specific composition.

Again, note that the flow-rates quoted are those measured using water according to the experimental procedure defined herein. Note that consumers dose foam products volumetrically—that is, they judge how much volume is dispensed in a given time. The mass flow rate (g/s) is generally dependent on the density of the product being dispensed. In standard experimental procedure defined herein, using water with a density of 1 g/cm$^3$, the mass flow rate will be 20 g/s and the volumetric flow rate will be 20 ml/s. However, for a foam with a density in the region of 0.5 g/cm$^3$, as dispensed, the target mass flow rate would be 10 g/s.

Known valves used for similar purposes tend to provide high flow-rates in conjunction with low cracking pressures, or low flow-rates in conjunction with high cracking pressures. Valves according to embodiments of the invention can allow the flow-rate in the open configuration to be decoupled from the cracking pressure to a greater extent, thereby allowing relatively high flow-rates in the open configuration in conjunction with moderate cracking pressures.

BRIEF DESCRIPTION OF THE DRAWINGS

The invention will now be described by way of example with reference to the accompanying drawings in which.

Figure 1A:
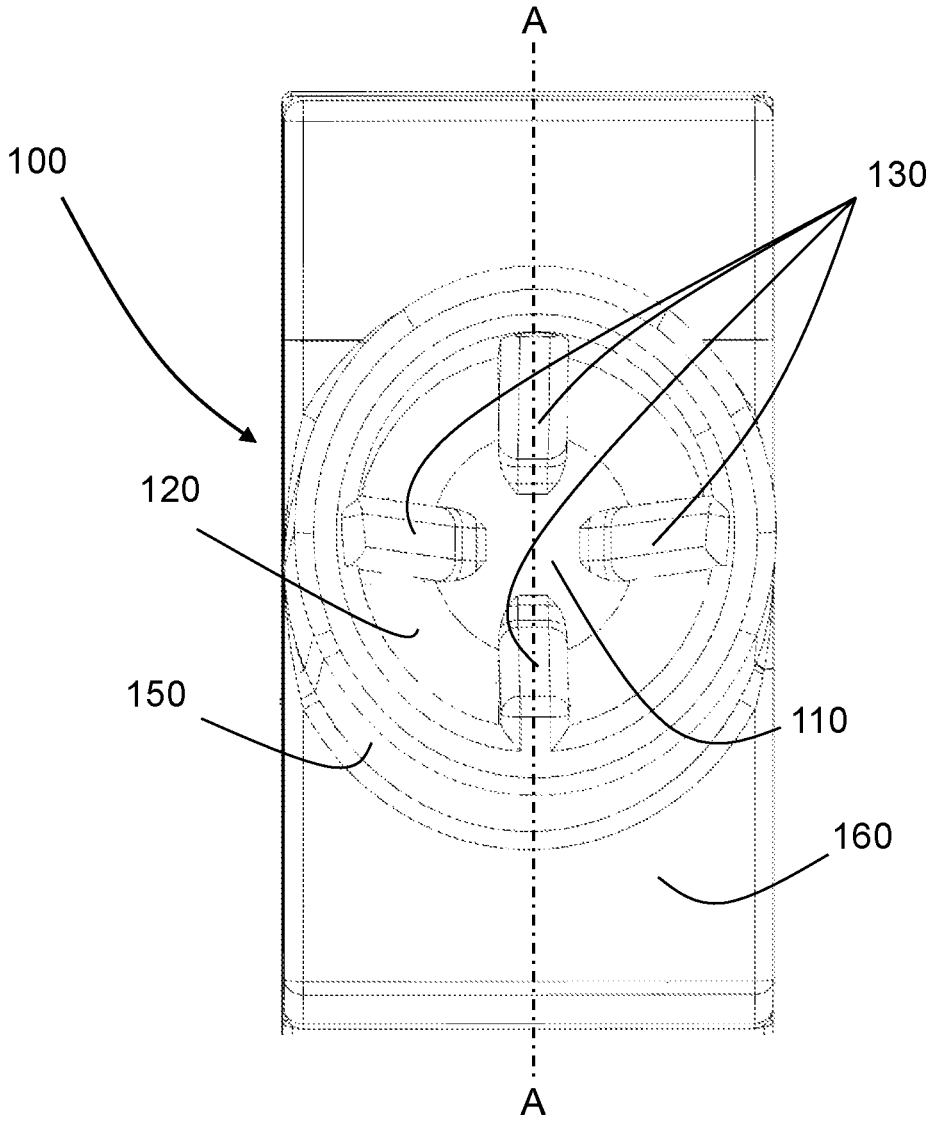
FIG. 1A is a front elevation of a valve of a dispensing device according to an embodiment of the invention.

It should be noted that these figures are diagrammatic and not necessarily drawn to scale. Relative dimensions and proportions of parts of these figures have been shown exaggerated or reduced in size, for the sake of clarity and convenience in the drawings.

DETAILED DESCRIPTION OF THE INVENTION

Figure 1B:
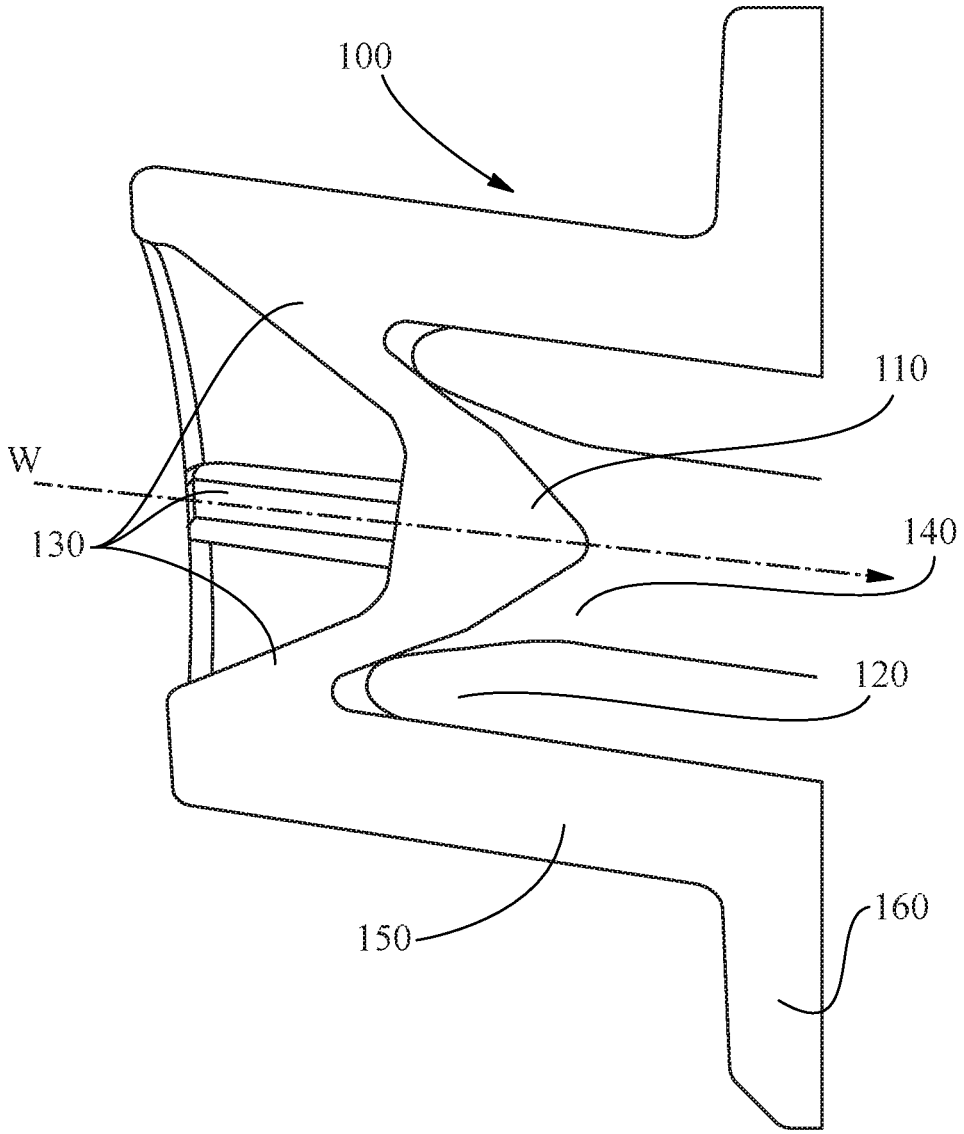
FIG. 1B is a cross sectional side view taken along the line A-A in FIG. 1A showing the valve in the closed configuration.

FIG. 1A is a front elevation of a valve 100 of a dispensing device according to an embodiment of the invention. FIG. 1B is a cross sectional side view of the valve 100 taken about the line A-A of FIG. 1A. The valve 100 comprises a plug 110, a seat 120; and a plurality of resilient arms 130. The seat 120 is configured to receive the plug 110 to act as a seal. The resilient arms 130 are configured to bias the plug 110 against the seat 120. In the embodiment pictured, there are four arms, symmetrically arranged around the circumference of the plug, as shown in FIG. 1A.

Figure 1C:
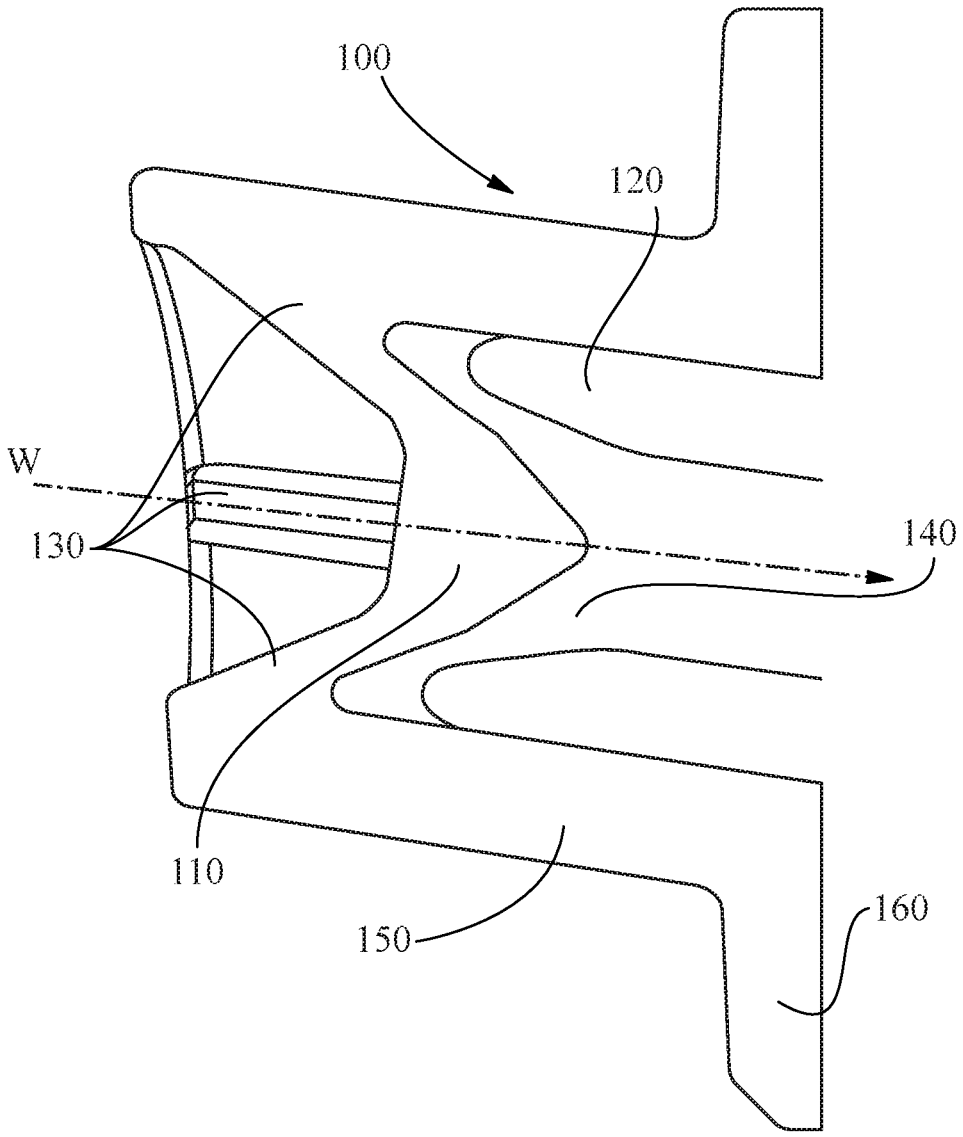
FIG. 1C is a cross sectional side view taken along the line A-A in FIG. 1A showing the valve in the open configuration.

The valve 100 has a closed configuration, as shown in FIG. 1B, in which the plug 110 is received by the seat 120. The valve 110 also has an open configuration in which the plug 110 is displaced from the seat 120, as shown in FIG. 1C.

As shown, the seat 120 in this example is provided by a tapered aperture 140 formed at the end of a tube 214. In the closed configuration, the plug 110 locates in this aperture 140 to restrict the flow of the product. Because of the resiliency of the plug 110, the plug 110 is compressed against the seat 120 to some degree in the closed position. FIG. 1C illustrates the relaxed cross sectional shape of the plug, without deformation, corresponding to the open configuration. FIG. 1B illustrates the interference between the plug and the seat deforming the plug, in the closed configuration.

When moving from the closed position to the open position, there may be a period in which the plug 110 is still located in the aperture 140. Indeed, the plug may still be partly located in the aperture even in the open configuration, as shown in FIG. 1C.

The plug 110 is suspended concentrically in the aperture 140 by the resilient arms 130. As seen in FIG. 1B, the resilient arms 130 extend partly radially and partly axially from the plug 110. In particular, the arms 130 extend at an oblique angle to the axial direction. The axial direction of the plug 110 is defined by the axis of displacement of the plug 110 away from the seat 120, as shown by line W. The radial direction of the plug 110 is perpendicular to the axial direction. By having the arms extend in this manner, the plug 110 can be suspended relative to the seat 120 without interfering with the seat's ability to receive the plug 110.

The resilient arms 130 are coupled to the plug 110 at a side of the plug 110 facing away from the seat 120. Again, this facilitates suspension of the plug 110 relative to the seat 120 without interfering with the seat's ability to receive the plug 110. It also means that the resilient arms can be mounted externally to the seat 120, which may contribute to simpler manufacture.

The plug 110 tapers inwardly in the positive axial direction of the plug 110, wherein the positive axial direction of the plug 110 is defined by the direction the plug 110 moves along its axis of displacement W when moving from the open to closed position, as shown by the directional arrow of axis W.

The plug 110 and the seat cooperate to define an opening of annular cross-section around the plug 110 when the valve is in the open configuration. When viewed from the front (see FIG. 1A), part of the annular opening is occluded by the resilient arms.

The aperture 140 forming the seat 120 tapers inwardly with a convex rounded profile in the direction away from the plug—that is, in the positive axial direction of the plug, as shown by the directional arrow of line W. As already mentioned above, the plug 110 is configured to resiliently deform against the tapered aperture 140 in the closed configuration.

The valve 100 further comprises a sleeve 150. The resilient arms 130 are coupled to an interior surface of the sleeve to suspend the plug inside the sleeve. The sleeve is tubular and the arms suspend the plug concentrically within the sleeve. A concentrically suspended plug may be useful, together with equally spaced resilient arms, to allow a more uniform flow profile.

The sleeve comprises a radial flange 160 for securing and/or locating the valve in the dispensing device. In this embodiment, the flange is seen to have the outline of a substantially rectangular plate (see FIG. 1A); however, this is not essential. The flange helps to secure the valve in particular against movement in an axial direction.

The plug 110, the resilient arms 130, the sleeve 150, and the flange 160 are formed integrally as a single molded piece of elastomeric material—namely, silicone rubber. The characteristics of the valve are influenced by the shape of the plug and the hardness of the rubber. This will be discussed in greater detail below.

Figure 2:
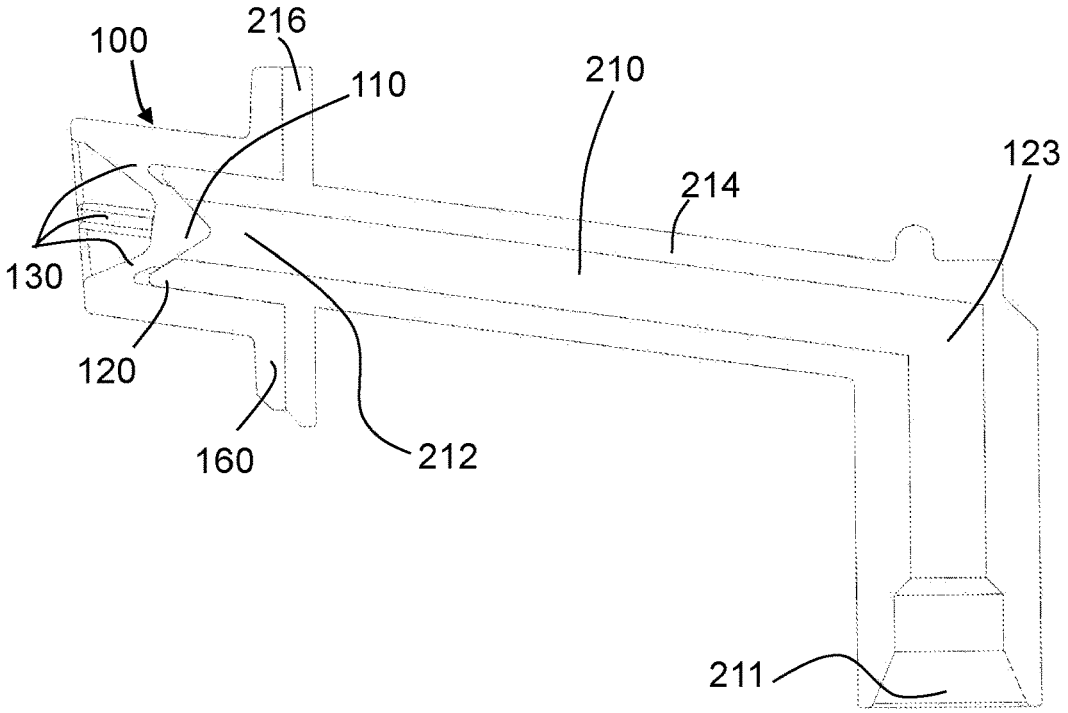
FIG. 2 is a cross sectional side view of the valve taken along the line A-A of FIG. 1A, and showing a dispensing channel in full.

Referring now to FIG. 2, the dispensing device further comprises a dispensing channel 210. The dispensing channel has an inlet 211 and an outlet 212. The inlet is disposed at the opposite end of the dispensing channel from the outlet. The inlet is configured to be coupled to a valve-element of a container containing the foamable product (not shown). The outlet is for dispensing the foamable product. The valve 100 of the dispensing device is located at the outlet of the dispensing channel 210.

The dispensing channel is formed by a tube 214. The seat 120 of the valve is formed by an end of the tube 214. In other words, the inwardly tapering aperture forming the valve-seat is provided at the end of the tube 214. To minimize the number of components, the seat 120 is wholly formed by the end of the tube. To allow the end of the tube 214 to form the valve-seat 120, the tube 214 projects into the sleeve 150. The tube has a radial flange 216 which corresponds to the radial flange 160 on the sleeve 150. When the device is assembled, the flange 160 and flange 216 are secured together. This facilitates the correct location of the plug relative to the seat in the axial direction.

As seen, the dispensing channel further comprises a bend 123 such that the inlet 211 and the outlet 212 of the dispensing channel are oriented differently from one another. The angle between the inlet 211 and outlet is slightly greater than 90°, in this embodiment.

Figure 3:
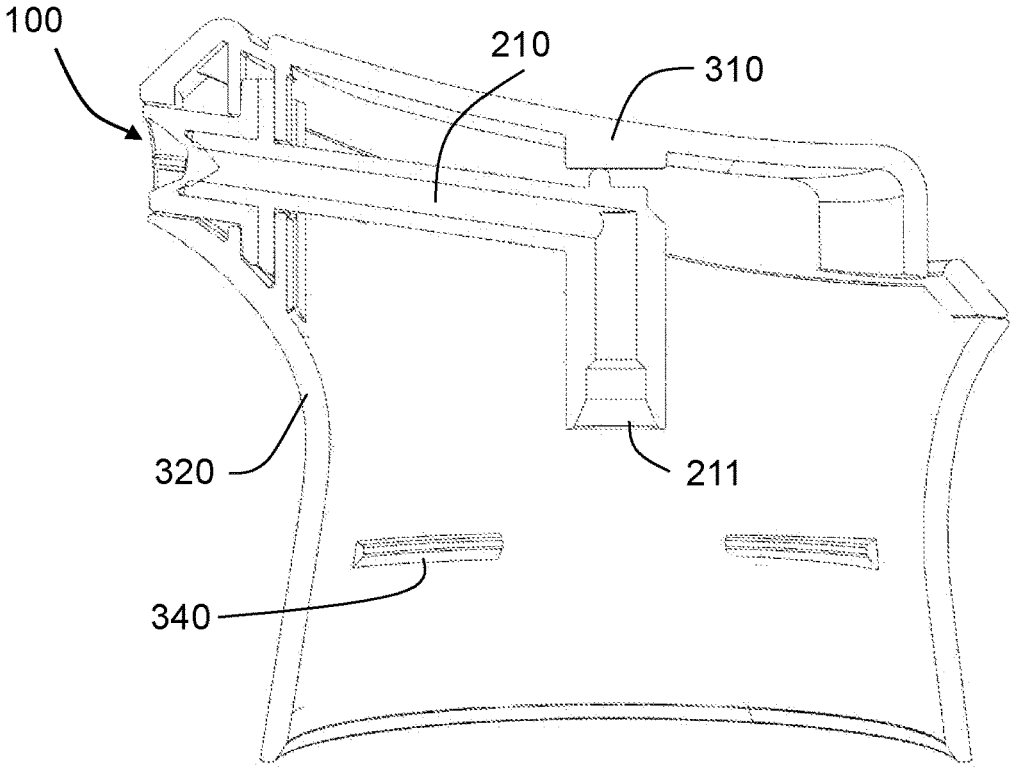
FIG. 3 is a cross sectional side view of the valve, the dispensing channel, and a shroud taken along the line A-A of FIG. 1A.

Referring now to FIG. 3, the dispensing device further comprises an actuator 310. The actuator is configured to bias the inlet 211 of the dispensing channel 210 against the valve-element of the container (see FIG. 4).

The tube 214 defining the dispensing channel 210 is made of polypropylene, so that it is flexible and resilient. A flexible and resilient dispensing channel allows the inlet 211 of the dispensing channel 210 to be biased against the valve-element of the container while the outlet remains static relative to the container.

The dispensing device further comprises a shroud 320. The shroud conceals the internal components of the dispensing device, such as the dispensing channel 210. The shroud 320 has retaining means to secure the outlet 212 of the dispensing channel 210 such that it is fixed relative to the shroud. The shroud also functions to secure the two flanges 216 and 160 against one another. This resists axial movement of the silicone rubber sleeve 150 relative to the tube 214.

The shroud 320 has fastening means 340 for engaging with a container 400. In the present embodiment, the fastening means is a type of snap-fit fastening.

Figure 4:
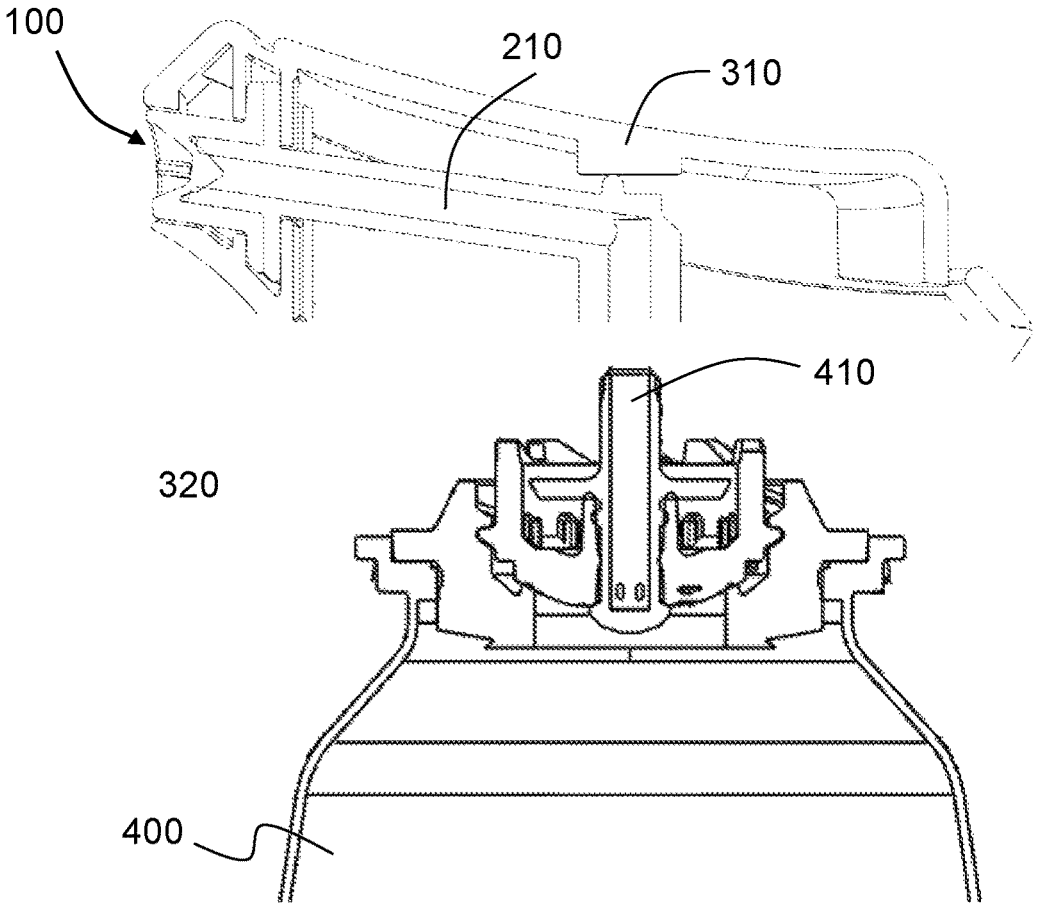
FIG. 4 is a cross sectional side view of the valve, the dispensing channel, and the shroud, taken along the line A-A of FIG. 1A, also showing schematically a container for foamable product.

Now referring to FIG. 4, the dispensing device further comprises a container 400 containing a foamable product. The container contains a cosmetic product and a propellant. The container 400 comprises a valve-element 410 coupled to the inlet 211 of the dispensing channel 210. In the present embodiment, the dispensing pressure of the container is 46 PSIG.

The container 400 is compatible with the fastening means 340 of the shroud 320.

As the outlet 212 of the dispensing channel 210 is fixed relative to the shroud, the outlet is also fixed relative to the container 400.

Prior to use, the valve 100 of the dispensing device and the discharge valve of the container will be in their respective closed configurations and thus restricting the flow of foamable product.

To use the dispensing device, the user presses down on the actuator 310. Upon actuation of the actuator 310, the inlet 211 of the dispensing channel bears against the valve-element 410 of the container and thereby opens the discharge valve of the container. With the discharge valve of the container open, the foamable product can flow out of the container and into the dispensing channel The foamable product is propelled from the container with a dispensing pressure that is substantially equal, accounting for pressure loss, to the pressure within the container.

Upon entering the dispensing channel, the foamable product forms a foam. In this example, the foam has a density in the range 0.4 to 0.5 g/cm$^3$ immediately after dispensing. The foam has a density in the range 0.1 to 0.2 g/cm$^3$ one minute after being dispensed. Thus the foam continues to expand significantly within the dispensing channel for some time after it has been dispensed.

As the valve 100 is initially in the closed configuration, pressure in the dispensing channel quickly builds until it is comparable to the dispensing pressure. This pressure is applied to the inside of the plug 110. Since the dispensing pressure exceeds the cracking pressure of the valve 100, the valve 100 opens. Note that the valve opens automatically under the pressure applied by the foamable product in the dispensing channel—no additional operation or mechanism is necessary.

In the open configuration, the foam is forced through the dispensing channel, and out via the valve 100 at the outlet 212. In doing so, the foam passes through the valve by flowing around the periphery of the plug. In this embodiment, the foam flows around the four resilient arms.

The cracking pressure of the valve is less than the dispensing pressure of the container. The cracking pressure of the valve is greater than the expansion pressure of a foam formed by the foamable product in the dispensing channel.

After the user has dispensed the desired amount of foam, the user releases the actuator, which closes the discharge valve of the container again. The valve 100 of the dispensing device then closes automatically, since the expansion pressure of the residual product in the dispensing channel is less than the cracking pressure of the valve. This enables the valve to reduce drooling of the foamable product from the outlet of the dispensing channel. Again, the shut-off of the valve 100 is automatic, in response to the drop in pressure once the discharge valve of the container is closed. No additional operation or mechanism is required.

The embodiment described above may be particularly suitable for dispensing a cosmetic product, in particular a foamable hair cosmetic product, such as a foamable shampoo or foamable conditioner. Expansion pressures of such products may be higher than other foamable products dispensed in this way. Therefore, it is particularly desirable to obtain better control of drooling for such products.

Test Method for Flow vs. Pressure

A test method will now be described for measuring the flow vs. pressure characteristics of valves according to embodiments of the invention. This test method can be used, for example, to determine the cracking pressure of the valve, wherein cracking pressure is defined as the minimum pressure at which the flow-rate through the valve is at least 5 ml/s.

Figure 5:
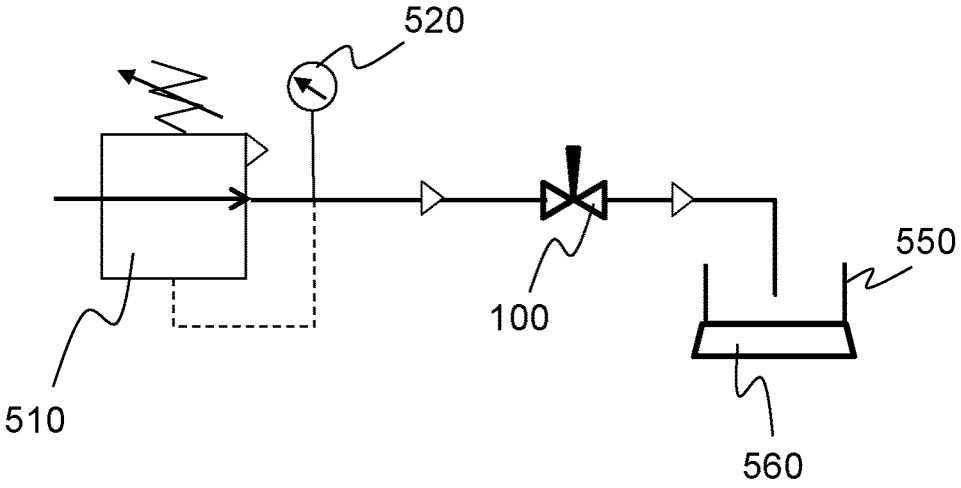
FIG. 5 is a schematic diagram illustrating an experimental apparatus used for testing the pressure versus flow-rate characteristics of valves.

A schematic diagram of the experimental apparatus is shown in FIG. 5. The apparatus comprises a pressure regulator 510 including a pressure pot and a gauge 520. It also comprises the valve 100 under test and a reservoir 550 positioned on a weighing scales 560. Since different foams would have different flow characteristics, all benchmark tests are conducted using type II pure water. The objective of the experiment is to measure the flow-rate for each of a range of applied steady-state pressures. The pressure regulator 510 delivers water at a steady-state pressure, which can be read from the gauge 520. The gauge 520 is accurate to ±5%. The water is supplied at 15° C. The experiment is carried out at an ambient room temperature of 20° C. and a pressure of 1 atm. the water supplied by the pressure regulator is coupled to the valve 100. The output of the valve flows into the reservoir 550. The flow-rate through the valve is thus determined by the rate of change of the mass of water in the reservoir 550, as measured by the scales 560. The accuracy of the scales 560 is ±0.01 g.

The apparatus and test procedure are substantially identical to those described in ISO 5208-2008, with one minor difference: whereas ISO 5208 measures the flow-rate by applying a steady-state pressure over a period of one minute, in the present experiment flow-rate is measured by applying a steady-state pressure for 10 seconds.

The mass flow rate is determined by measuring the average change in mass in the reservoir 550 over the 10 second period. In other words, if the mass of the reservoir increases by 20 g during the 10-second period, the mass flow rate into the reservoir is determined to be 2 g/s (20 g÷10 s). The volumetric flow rate is then straightforward to calculate: since the density of water is 1 g/cm$^3$, a mass flow rate of 1 g/s is equivalent to a volumetric flow rate of 1 ml/s.

Flow-rates are measured at increments of 10 PSIG—namely, at 0, 10, 20, 30, 40, 50, and 60 PSIG. Linear interpolation is used between the measured data points. This linear interpolation allows the cracking pressure to be estimated, by finding the pressure that corresponds to a flow-rate of 5 ml/s.

Experiments were conducted on a number of different plug shapes, using silicone rubber of varying Shore hardness for the integrally formed plug, sleeve, and resilient arms, as illustrated in the drawings. A baseline test was also performed, for comparison, without any plug present in the valve. This is intended to represent the unrestricted flow of water, in the absence of a valve and is labeled "unrestr" in the drawings.

Results

Figure 6:
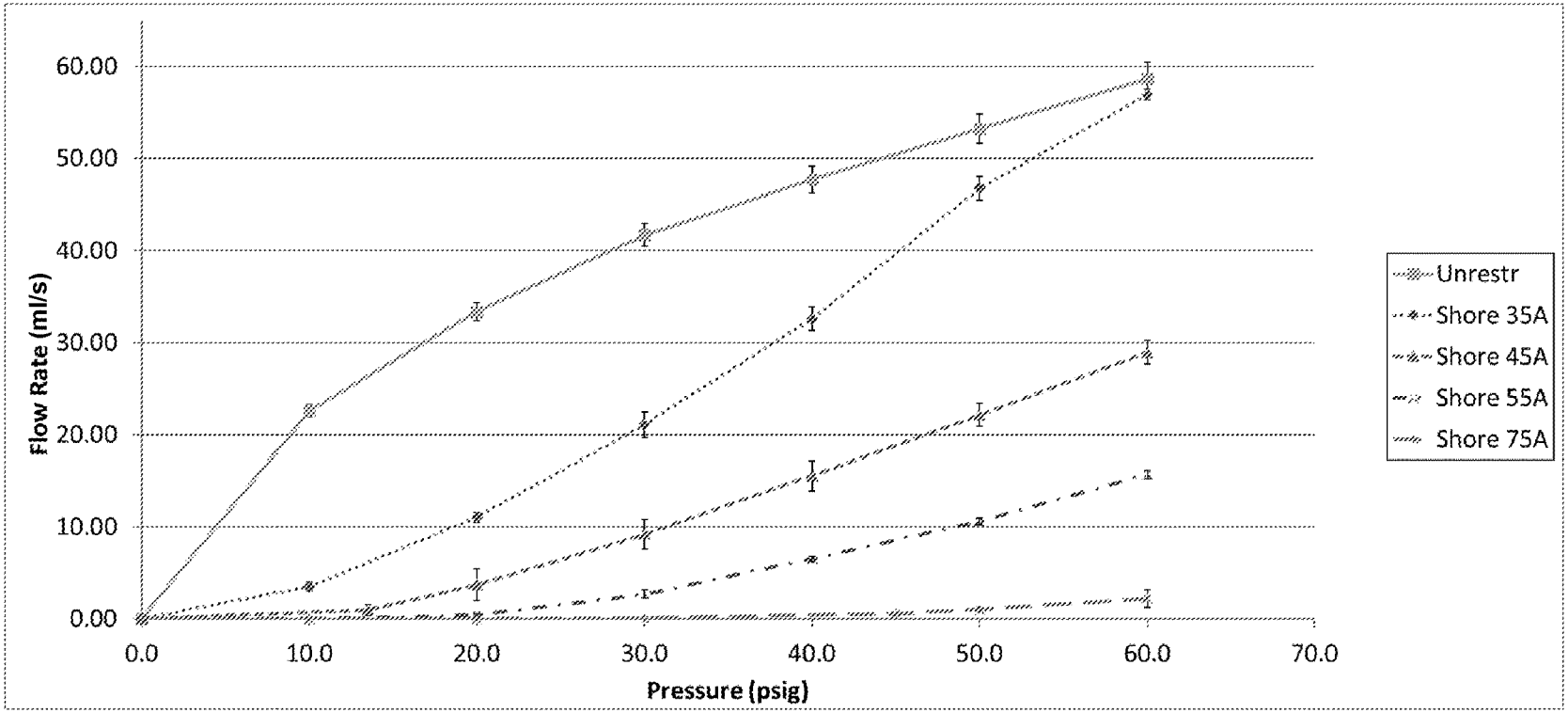
FIG. 6 is a graph showing pressure versus flow-rate characteristics for a set of valves having a cone-shaped plugs that taper at an angle of 30°.
Figure 7:
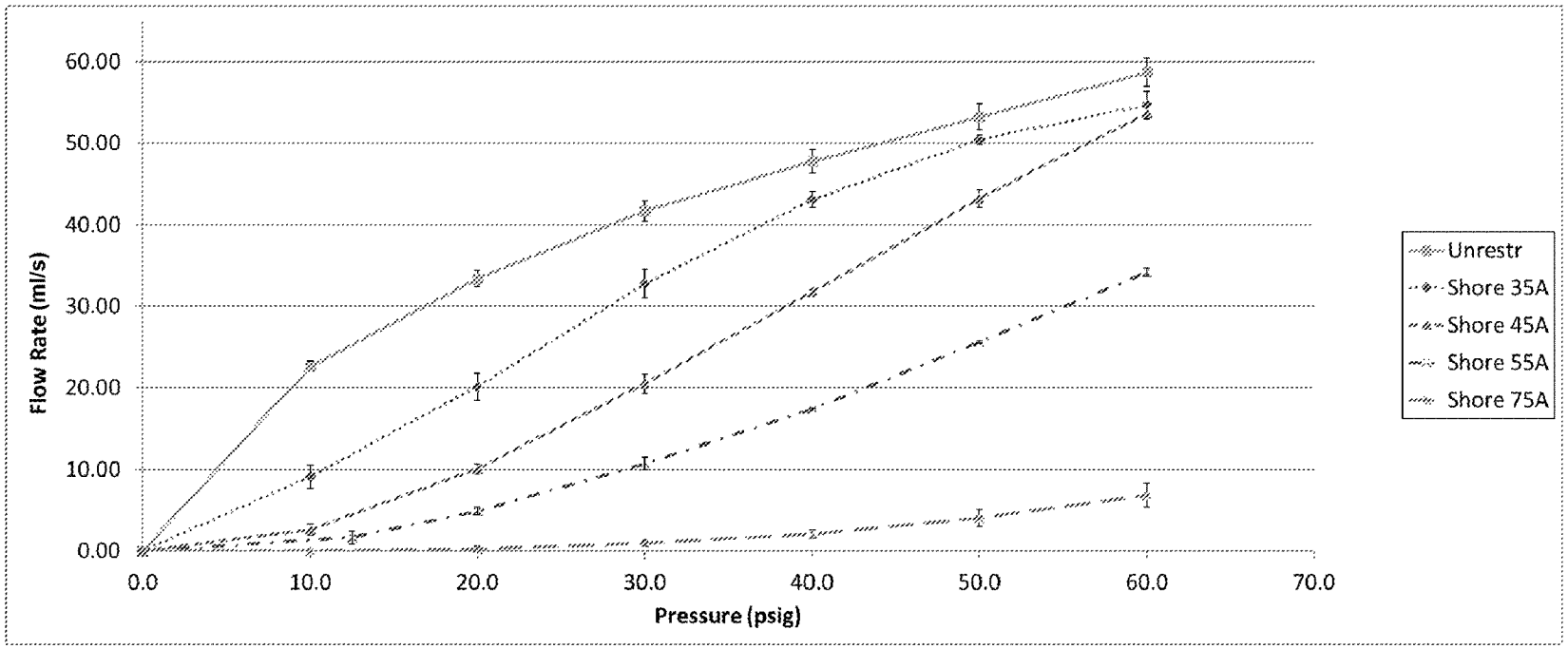
FIG. 7 is a graph showing pressure versus flow-rate characteristics for a set of valves having a cone-shaped plugs that taper at an angle of 55°.

FIG. 6 shows results for plugs having a conical shape tapering at 30°. FIG. 7 shows results for plugs having a conical shape tapering at 55°. In these experiments, interference between the plug and seat was 10 mil (0.25 mm). Each point on the plot is the mean of three tests on identical plugs, with the standard deviation among measurements indicated with error bars.

For the 30° cone of FIG. 6, the cracking pressures are as shown in Table I below. For the 55° cone of FIG. 6, the cracking pressures are as shown in Table II below.

TABLE I

| Cracking pressure for 30° cones (PSIG) | | | | |
|---|---|---|---|---|
| Shore hardness | 35A | 45A | 55A | 75A |
| Cracking pressure (PSIG) | 12.0 | 22.4 | 35.0 | >60.0 |

TABLE II

| Cracking pressure for 55° cones (PSIG) | | | | |
|---|---|---|---|---|
| Shore hardness | 35A | 45A | 55A | 75A |
| Cracking pressure (PSIG) | 5.6 | 12.5 | 20.2 | 53.4 |

Among the 30° cones, the most preferred plug for the present embodiment was found to be the one having a Shore hardness of 45A. This provides a desirable flow rate of about 22 ml/s at a pressure of 50 PSIG, in conjunction with a cracking pressure of about 22 PSIG.

Among the 55° cones, the most preferred plug for the present embodiment was found to be the one having a Shore hardness of 55A. This provides a desirable flow rate of about 26 ml/s at a pressure of 50 PSIG, in conjunction with a cracking pressure of about 20 PSIG.

These results are representative of a general relationship between taper angle and hardness of the material. The higher the durometer, the lower the flow rate at high pressure but also the greater the sealing ability of the plug at low pressure. Meanwhile, the greater the cone angle, the greater the flow-rate at high pressure but also the lesser the sealing ability at low pressure. All else being equal, a plug with a greater cone angle should be manufactured from harder elastomer.

It has been found that both the seal contact pressure and sealing system performance are relatively insensitive to the contact interference between the plug and seat, in the range tested (10 to 30 mil, or 0.25 to 0.77 mm). However, it is noted that excessive interference may deform the seal and cause an increase of the seal contact patch while reducing the maximum contact pressure and result in a flow rate increase.

The graphs show that a good trade-off is achievable between, on the one hand, providing adequate flow-rates at typical dispensing pressures of foam containers and, on the other hand, providing better sealing so that drool is reduced. Note that drool need not be completely eliminated—the dispensing device will be acceptable to consumers provided that the amount of drool is sufficiently small. The flow-rate of 5 ml/s used to define the cracking pressure of the valve has been found to correlate well with the amount of drool that would be acceptable. Note that the absolute flow-rate of foam through the valve will generally not be as great as 5 ml/s at the cracking pressure. The foam being dispensed will typically be more viscous than the water used for these standard tests; therefore, a lower flow-rate of foam will be observed.

As mentioned already above, the flow rates and cracking pressure of the valve are measured using water, to provide absolute measures that are independent of the foam product to be dispensed. The cracking pressure measured with water provides an "absolute" measure of the sealing system performance For a specific foamable product composition: the cracking pressure is expected to change according to surface tension of the foam—the higher the surface tension, the higher the cracking pressure. Thus, depending on the surface tension of the foam to be dispensed, the cracking pressure of the valve should be adjusted accordingly. Nevertheless, for the foam product that was used to develop the design criteria applied in the examples above, it was found that the cracking pressure for water and the cracking pressure for the foam composition being sealed were similar.

In the same way, the target flow rate measured with water at the dispensing pressure provides an "absolute" measure of the sealing system performance. For a specific foamable product composition, the target flow rate at the dispensing pressure is expected to change according to the specific foam viscosity. The design criteria for the valve should thus be adjusted accordingly.

As those skilled in the art will appreciate, the design criteria for the valve will vary depending upon the type of foam being dispensed (for example with respect to characteristics such as viscosity and expansion pressure), the dispensing pressure, and the precise application being targeted (some applications may require greater flow-rates than others, in the open configuration of the valve). Accordingly, the design criteria used in the embodiments discussed are exemplary, not limiting.

Test Method for Expansion Pressure

Figure 8:
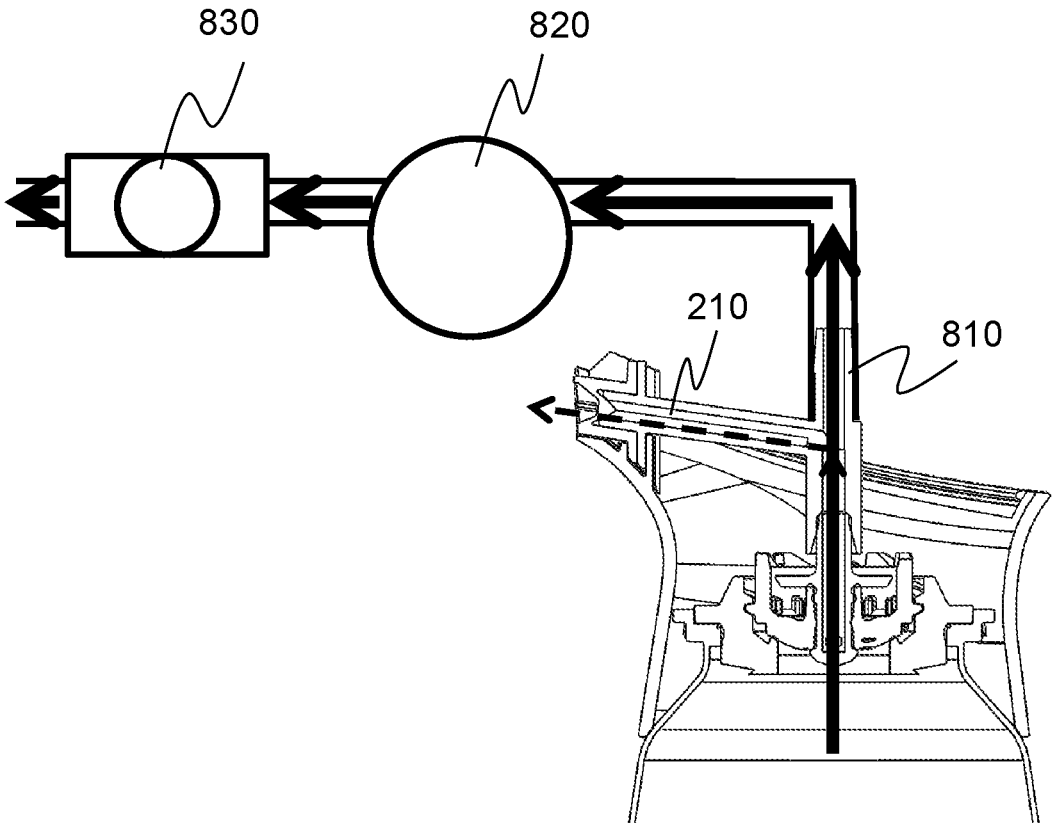
FIG. 8 represents experimental setup for measuring the expansion pressure of foam in the dispensing channel.

A test method will now be described for measuring the expansion pressure of foam in the dispensing channel. The experimental setup is illustrated in FIG. 8. The dispensing channel 210 is modified with the addition of a spur 810. This spur 810 is coupled to a ball valve 830 which can be manually opened and closed to provide an alternative flow path from the dispensing channel to the external atmosphere. A pressure gauge 820 is provided between the spur 810 and the ball valve 830.

The test procedure is as follows. Firstly, the ball valve 830 is opened. The discharge valve of the container is then opened to dispense foamable product, by pressing down on the valve element of the container in the normal way. The product will flow through the spur 810 and out via the ball valve 830 (the path indicated by solid arrows in FIG. 8). Next, the ball valve 810 is closed, while leaving the discharge valve of the container open. The foamable product will therefore be forced through its normal path through the dispensing channel 210 (the path indicated by the dashed arrow in FIG. 8). When the product is flowing steadily through the dispensing channel, the discharge valve of the container is closed. This simulates the end of a normal dispensing event. As soon as the discharge valve is closed, the pressure is read from the pressure gauge 820. This pressure is the expansion pressure of the foam in the dispensing channel 210.

Although specific embodiments have been described, those skilled in the art will appreciate that various modifications are possible.

For instance, the number of resilient arms used in an embodiment can vary. The geometric and material properties of the arms may be adapted to provide a suitable valve. In this connection, any suitable cross sectional geometry and material may be used for the resilient arms. Although three to four arms are preferred as a compromise between the stability of the plug and a low obstruction of flow, there may be benefits in having a different number of arms. Even further, the spacing of the arms can vary provided the geometric and material properties of the individual arms are adapted to provide a suitable valve. It may, however, be desirable to have a symmetrical arrangement of arms in order to give a uniform flow profile. In a further variation, the resilient arms may extend from the plug at right angles to an exterior surface of the plug. In another variation, the resilient arms may extend from the plug in a direction along either the axial or radial axes of the plug. Nevertheless, it is believed that the presented configuration for the resilient arms is an effective solution as it minimizes complexity and provides an effective and predictable sealing force.

It is also possible to modify the plug. For example, the plug may have a conical, frusto-conical, pyramidal, frusto-pyramidal, cylindrical, or otherwise prism-like shape. Furthermore, the plug may or may not be tapered. If the plug is tapered, the angle at which it tapers can be in the range 20° to 60°, preferably in the range 30° to 45°, more preferably about 45°. In general, the plug may be formed by the same material as the resilient arms, or it may be formed by a different material. Also, the plug and the resilient arms may be separate components or, conversely, they may be a single integrally formed component. Likewise, the plug, the resilient arms, and the sleeve may be separate components or, conversely, they may be a single integrally formed component.

The seat can also be modified. For example, the seat may or may not be formed by a part of the dispensing channel. If the seat is not part of the dispensing channel, the seat may have a fastening means for attaching to the dispensing channel. It may or may not be formed of the same material as the dispensing channel. Similarly, where the seat is part of the dispensing channel, it may or may not be formed of the same material as the rest of the dispensing channel. The seat may or may not be elastically deformable, and it may or may not be formed by a flexible resilient material. The seat may be formed by a flexible resilient plastics material such as a polyolefin, preferably polypropylene, although any suitable plastic could be used. However, in other embodiments, the seat may be formed of other material, such as a metal. In general, the aperture of the seat may or may not taper. If the aperture of the seat does taper, it may comprise a taper at an angle in the range of 20° to 60°, preferably about 45°. The seat may have a sharp or rounded profile, wherein a sharp profile refers to a rim having a fillet radius of less than 1 mm, less than 0.5 mm, or less than 0.25 mm.

The sleeve can also be modified. For instance, the sleeve of the valve may have a cross section that is circular, square, rectangular, ovular, triangular, or otherwise polygonal. In some embodiments, the radial flange of the sleeve of the valve may be square, rectangular, circular, ovular, triangular, or otherwise polygonal in shape. The radial flange of the sleeve of the valve may help secure the valve against movement in any direction such as the axial or radial directions; it may further prevent angular rotation of the sleeve.

The interactions between the plug, the seat, the resilient arms, and the sleeve can also vary. For instance, although in the embodiments discussed above the plug is suspended within the sleeve by resilient arms coupled to the interior surface of the sleeve, the resilient arms may alternatively or additionally be coupled to the exterior surface of the sleeve, or to some other component near the seat. In another variation, the seat may be formed integrally with the plug, the arms, and the sleeve. The plug and the seat may or may not have corresponding faces when in the closed configuration. Here, corresponding faces refer to sets of faces which touch at a substantial portion of the face area; for instance, a corresponding face may touch at a minimum of 30%, 40%, 50%, 60%, 70%, 80%, 90%, or 100% of the area of the smaller of the two corresponding faces.

The plug may be configured to resiliently deform against the tapered aperture in the closed configuration. The amount of resilient deformation may be measured by a depth of indent from an exterior surface of the plug. For instance, an exterior surface of the plug may be indented to a depth between 10 to 30 mil (0.25 to 0.77 mm). The amount of resilient deformation may be estimated by measuring the axial position of the plug relative to the seat and comparing this position with the expected position if there was no interference between plug and seat. This axial displacement of the plug can then be converted into an estimate of the deformation in a direction normal to the surface of the plug, based on knowledge of the plug geometry.

It is also possible to vary features relating to relationships between the components, such as the valve, dispensing channel, actuator, shroud, and container. For instance, whilst the valve is preferably located at the outlet of the dispensing channel to minimize drool, it may be necessary to place the valve at another point along the dispensing channel if obstructions or design constraints exist; in such cases, it could be placed at any point along the dispensing channel. Furthermore, although it is preferable for the actuator to bias the inlet of the dispensing channel against the valve-element of the container, it may also be possible for the actuator to directly actuate the valve-element of the container. This design may provide other benefits such as being able to reduce the structural requirements of the dispensing channel. Referring still to the actuator, the actuator may, dependent on the properties of the dispensing channel, contact a range of points along the dispensing channel and still bias the inlet of the dispensing channel against the valve-element of the container; this range could be defined as being within 75 to 100%, 50 to 100%, or 25 to 100% of the distance from the outlet to the inlet, 100% meaning actuation in line with the inlet. Even further still, the nature of the fixing means used to fix the position of the outlet of the dispensing channel relative to the shroud can vary without departing from the scope of the claims. For instance, the outlet of the dispensing channel may be fixed relative to the shroud through physical contact with another component, the other component being in physical contact with the shroud. The method by which the container is coupled to the shroud may also vary. Although shown as a snap-fit connection in the drawings, the container could be coupled to the shroud through use of a screw-fit, a bayonet-fit, an adhesive, and/or other suitable means.

The nature of the interaction between the dispensing channel and the valve-element of the container may also vary. Two commonly used types of container valve-element are the male type and the female type. Either type is suitable to work with embodiments of the present invention. The male type, as shown in FIG. 4, comprises a valve-stem which in this case is securely engaged with the inlet of the dispensing channel. The female type, not shown, has a spring cup for engagement with a stem. If a female type valve element were to be used, the stem may be provided by the inlet of the dispensing channel or an adapter may be placed between the female type valve element and the inlet of the disclosed dispensing channel.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing device for dispensing a foamable product, the dispensing device comprising a valve, the valve comprising:

a plug;

a seat configured to receive the plug;

a sleeve comprising an interior surface;

one or more resilient arms coupled to the plug and the interior surface of the sleeve to suspend the plug inside the sleeve, wherein the one or more resilient arms are configured to bias the plug against the seat, the valve having a closed configuration in which the plug is received by the seat, an open configuration in which the plug is displaced from the seat;

a dispensing channel, the dispensing channel comprising:

an inlet for communicating with a valve-element of a container containing the foamable product; and an outlet for dispensing the foamable product, wherein the valve of the dispensing device is located at the outlet of the dispensing channel.

2. The dispensing device of claim 1, wherein the one or more resilient arms extend radially from the plug.

3. The dispensing device of claim 1, wherein the one or more resilient arms extend from the plug at an oblique angle.

4. The dispensing device of claim 1, wherein the one or more resilient arms are coupled to the plug at a side of the plug facing away from the seat.

5. The dispensing device of claim 1, wherein the plug tapers inwardly in the direction toward the seat.

6. The dispensing device of claim 1, wherein the sleeve comprises a radial flange for securing the valve in the dispensing device.

7. The dispensing device of claim 1, wherein the plug and the one or more resilient arms are formed integrally from an elastomeric material.

8. The dispensing device of any one of claim 1, further comprising a shroud for concealing the dispensing channel when the dispensing device is attached to a container containing the foamable product, wherein the position of the outlet of the dispensing channel is fixed relative to the shroud.

9. The dispensing device of claim 1, wherein the valve has a cracking pressure in the range 5 to 30 PSIG.

10. The dispensing device of claim 1, wherein the seat comprises an aperture that tapers inwardly in the direction away from the plug.

11. The dispensing device of claim 10, wherein:

the seat comprises an aperture that tapers inwardly in the direction away from the plug; and the plug tapers inwardly in the direction toward the seat, wherein the tapered plug is configured to form an interference fit with the tapered aperture in the closed configuration of the valve.

12. The dispensing device of claim 1, wherein the dispensing channel comprises a tube and wherein the seat comprises an end of the tube.

13. The dispensing device of claim 12, wherein:

the end of the tube projects into the sleeve such that the plug locates against the seat in the closed configuration.

14. The dispensing device of claim 1, further comprising an actuator configured to bias the inlet of the dispensing channel against the valve-element of the container.

15. The dispensing device of claim 14, wherein the dispensing channel is flexible and resilient.

16. The dispensing device of any one of claim 1, further comprising the container containing the foamable product, wherein the valve-element of the container is coupled to the inlet of the dispensing channel.

17. The dispensing device of claim 16, wherein a cracking pressure of the valve of the dispensing device is less than a dispensing pressure of the container but greater than an expansion pressure of a foam formed by the foamable product in the dispensing channel.

18. The dispensing device of claim 16, wherein the container contains a cosmetic product and a propellant.

* * * * *